US010221657B2

(12) United States Patent
Gosselin

(10) Patent No.: US 10,221,657 B2
(45) **Date of Patent: *Mar. 5, 2019**

(54) DRILLABLE AND RESETTABLE WELLBORE OBSTRUCTION-CLEARING TOOL

(71) Applicant: LONGHORN CASING TOOLS INC., Calgary (CA)

(72) Inventor: Randy Gosselin, High River (CA)

(73) Assignee: LONGHORN CASING TOOLS INC., Calgary (CA)

( * ) Notice: Subject to any disclaimer, the term of this patent is extended or adjusted under 35 U.S.C. 154(b) by 5 days.

This patent is subject to a terminal disclaimer.

(21) Appl. No.: 15/165,970

(22) Filed: May 26, 2016

(65) Prior Publication Data

US 2016/0348472 A1 Dec. 1, 2016

Related U.S. Application Data

(60) Provisional application No. 62/166,178, filed on May 26, 2015.

(51) Int. Cl.
*E21B 37/00* (2006.01)
*E21B 17/07* (2006.01)
*E21B 43/10* (2006.01)

(52) U.S. Cl.
CPC ..... *E21B 37/00* (2013.01); *E21B 17/073* (2013.01); *E21B 17/076* (2013.01); *E21B 43/10* (2013.01)

(58) Field of Classification Search
CPC ..... E21B 17/076; E21B 17/073
See application file for complete search history.

(56) References Cited

U.S. PATENT DOCUMENTS 1,641,206 A * 9/1927 Smith ..... E21B 6/00 175/322
1,688,994 A * 10/1928 Smith ..... E21B 17/073 173/151
4,270,620 A * 6/1981 Lawrence ..... E21B 17/07 175/322
8,191,655 B2 * 6/2012 Declute-Melancon ..... E21B 10/26 175/322
8,973,682 B2 * 3/2015 Gosselin ..... E21B 37/00 166/311
2004/0129457 A1 * 7/2004 McNeilly ..... E21B 4/02 175/57

(Continued)

*Primary Examiner* — Blake E Michener
(74) *Attorney, Agent, or Firm* — Parlee McLaws LLP (CGY); Sean Goodwin; Linda Thompson

(57) ABSTRACT

Embodiments of a reciprocating tool, used to engage and clear obstructions in a wellbore, have a biasing spring located externally about an axially reciprocating and rotatable sleeve to act between the rotatable sleeve and the non-rotatable mandrel to bias the rotatable sleeve to an extended position. During a drill out operation, a non-rotatable sleeve, connected to the mandrel for telescoping over the mandrel and the rotatable sleeve during a downstroke of the mandrel, guides a drill string for drill-out of at least the mandrel and other internal components. Positioning the biasing spring external to the rotating sleeve and downhole of the non-rotating sleeve prevents engaging the spring with the drill string. The rotating sleeve provides an internal guide for the drill out string to further avoid engagement with the spring.

15 Claims, 5 Drawing Sheets

(56) References Cited

U.S. PATENT DOCUMENTS

| | | | | |
|---|---|---|---|---|
| 2012/0285743 | A1* | 11/2012 | Gosselin | E21B 17/073<br>175/53 |
| 2016/0090816 | A1* | 3/2016 | Gosselin | E21B 33/14<br>166/332.1 |
| 2016/0326821 | A1* | 11/2016 | Gosselin | E21B 34/08 |

* cited by examiner 10
14
18
20
28
30

F
D
32
16
26
24
22
12

DRILLABLE AND RESETTABLE WELLBORE OBSTRUCTION-CLEARING TOOL

CROSS-REFERENCE TO RELATED APPLICATIONS

This application claims the benefit of U.S. provisional application 62/166,178 filed May 26, 2015, the entirety of which is incorporated herein by reference.

FIELD

Embodiments taught herein are related to apparatus and methods for clearing obstructions in wellbores during casing of the wellbores and, more particularly, to a reciprocating tool that is drillable when cemented in the wellbore.

BACKGROUND

In the oil and gas industry, following drilling of a vertical or horizontal wellbore into a formation for the production of oil or gas therefrom, the wellbore is typically cased and cemented to line the length of the wellbore. Lining the wellbore ensures safe control of production of fluids therefrom, prevents water from entering the wellbore and keeps the formation from "sloughing" or "bridging" into the wellbore.

It is well known that during the running in of a tubing string, such as a casing string, and particularly production casing, the casing may encounter tight spots and obstructions in the openhole wellbore, such as that created by sloughing of the wellbore wall into the open hole or as a result of the casing pushing debris ahead of the bottom end of the casing along the openhole until it forms a bridge. Such obstructions prevent the advance of the casing and require the openhole to be cleared in order to advance the casing to the bottom of the hole. This is particularly problematic in horizontal wellbores.

Should the casing string become sufficiently engaged in a mud pack formed at the obstruction, differential sticking may also occur, making advancing or removal of the casing from the wellbore extremely difficult.

While casing strings have been rotated to assist with moving past or through an obstruction, high torque created by trying to rotate a long string of casing may result in significant damage to the threads between casing joints and may cause centralizers and the like to drag and ream into the wellbore. While rotation of casing may be a viable option in a vertical wellbore, albeit fraught with problems, it is extremely difficult, if not impossible in a horizontal wellbore.

One option for addressing obstructions is to employ a washing technique; generally pumping fluids through the casing while the casing is axially reciprocated uphole and downhole. Should the washing technique be unsuccessful, it is known to trip out the casing and run in a mud motor on a drill string to drill out or ream the obstruction from the wellbore. Such repeated running in and tripping out of tubulars is time consuming, labor intensive and, as a result, very expensive.

Further, it has been contemplated to attach costly apparatus, such as mud motors, jetting or reaming tools, to the bottom of the casing string, however the apparatus is not retrievable thereafter from the wellbore and adds significantly to the cost of the casing operation.

Alternatively, others have contemplated providing teeth on the bottom of the casing string, or on a shoe at the bottom of the casing string, to assist with cutting away the obstruction as the casing is advanced during running in. Typically, the casing is also reciprocated or stroked during the clearing operation, or in some cases stroked at the same time as the casing is rotated. An example of a known reciprocating tool is a reaming tool, disclosed in U.S. Pat. No. 8,191,655 which issued on Jun. 5, 2012 to Halliburton Energy Services Inc.

Applicant, in related U.S. Pat. No. 8,973,682, incorporated by reference herein in its entirety, sets forth an obstruction-clearing tool that relies on reciprocation of the casing string to clear away wellbore obstructions. The tool uses an axially-actuated helical drive for rotational-actuation of a portion of the clearing tool, without the need to rotate the conveying casing string. Typically, a sleeve is axially extendable relative to a non-rotating mandrel during reciprocation of the mandrel and the casing string and is, at the same time, rotated about the mandrel as a result of the helical drive.

In embodiments, including those disclosed in Halliburton's U.S. Pat. No. 8,191,655, an axially-actuated helical drive can further comprise biasing means, such as a spring, which acts between the rotating and non-rotating components for biased-assistance in the extension of axially compressed components of the apparatus, such as when changing from a retracted position to an extended position.

In downhole operations, circumstances are known where an operator abandons a tool downhole and permanently cements the tool therein. Later, if the wellbore needs to be extended, a secondary drill string is run downhole through the casing string to drill or mill out the cemented tool in an operation called a drill-out operation. Generally, the drillable portions are made of less competent materials, such as aluminum and aluminum composites, cast iron or brass which facilitate being drilled out. In such cases, the portions that are made drillable are generally internal components which would otherwise interfere with or retard passage of the secondary drill string therethrough. The drill bit can also be drillable or its design accommodates passage of a drill string therethrough, such as a tubular drill bit.

In the case where the tool comprises a biasing member, such as the spring, it is inherent in its function that the spring is resistant to drilling, both as a result of the material from which the spring is constructed and the coiled configuration. If, during the drill-out operation, the biasing spring is inadvertently engaged by the drill, such as could readily occur as a result of the design of the Halliburton tool described in U.S. Pat. No. 8,191,655, the operation may be impeded, or possibly defeated, causing considerable problems with drilling through the cemented tool.

Ideally, what is required is a relatively simple and inexpensive apparatus for incorporation into the casing string for clearing wellbore obstructions, without the need for rotating the casing string, which can achieve an optimum extension of components within the tool from the retracted, axially compressed components therein. Further, it is desirable that the apparatus be drillable without a significant increase in operational costs.

SUMMARY

Embodiments disclosed herein teach a tool for engaging and clearing obstructions in a wellbore having a biasing spring located externally about an axially reciprocating and rotatable sleeve and acting between the rotatable sleeve and the non-rotatable mandrel for biasing the rotatable sleeve to an extended position relative thereto. Embodiments are particularly useful in horizontal wellbores where gravity does not generally participate in extending the rotatable sleeve. Further, a non-rotatable sleeve is connected to the mandrel for telescoping over the mandrel and the rotatable sleeve during a downstroke of the mandrel for guiding a drill string used for drill-out of at least the mandrel and other internal components. Positioning the biasing spring between the distal end of the non-rotatable sleeve and the distal end of the rotating sleeve permits compression of the spring therebetween as the mandrel and non-rotating sleeve move downhole within the rotating sleeve bore. In direct contradistinction to the Halliburton tool, which locates the spring about the helical drive arrangement on the mandrel, Applicant's positioning the biasing spring external to the rotating sleeve and downhole of the non-rotating sleeve prevents engaging the spring with the drill string. The rotating sleeve itself also provides an internal guide for the drill string to further avoid engagement with the spring.

In a broad aspect, a wellbore obstruction-clearing tool, is fit to a downhole distal end of a tubing string for advancing the tubing string through obstructions in a wellbore, the tubing string having an axial tubular bore therethrough, the tool comprising: a tubular, rotatable sleeve for engaging the obstructions, the rotatable sleeve having an axial sleeve bore extending axially therethrough and a disruptor connected to a distal end thereof. A tubular mandrel is adapted for connection to the distal end of the tubing string, the mandrel having an axial mandrel bore extending therethrough for fluid connection to the axial bore of the tubing string, the mandrel fit concentrically within the sleeve bore for axial reciprocation therein between an upstroke and a downstroke. A helical drive arrangement acts between the mandrel and the sleeve for driving the rotatable sleeve axially and rotationally along the mandrel during the downstroke and the upstroke of the mandrel between a retracted position and an extended position respectively. A non-rotatable sleeve is fit concentrically about the mandrel and attached thereto at an uphole end, the non-rotatable sleeve, the non-rotatable sleeve being located about the helical drive arrangement and fit telescopically about at least a portion of the rotatable sleeve during reciprocation of the mandrel. A spring is fit concentrically about an external surface of the rotatable sleeve and is operatively connected between a distal end of the non-rotatable sleeve and the distal end of the rotatable sleeve, wherein the distal end of the non-rotatable sleeve for energizing the spring in the retracted position, the non-rotatable sleeve telescoping axially over at least a portion of the rotatable sleeve and the biasing spring; and in the upstroke, the energized spring biases the rotatable sleeve to the extended position, resetting the helical drive.

In embodiments, the non-rotatable sleeve forms a drill guide along the mandrel; and the rotating sleeve forms a drill guide along the spring.

BRIEF DESCRIPTION OF THE DRAWINGS

FIG. 1A is a side view of an embodiment of the prior art wellbore obstruction clearing tool in an extended position;

FIG. 1B is a cross-sectional view according to FIG. 1A; and

FIG. 1C is a sectional view of the tool of FIG. 1B in a retracted position;

DESCRIPTION

Prior Tool

Figures 1A, 1B, 1C:
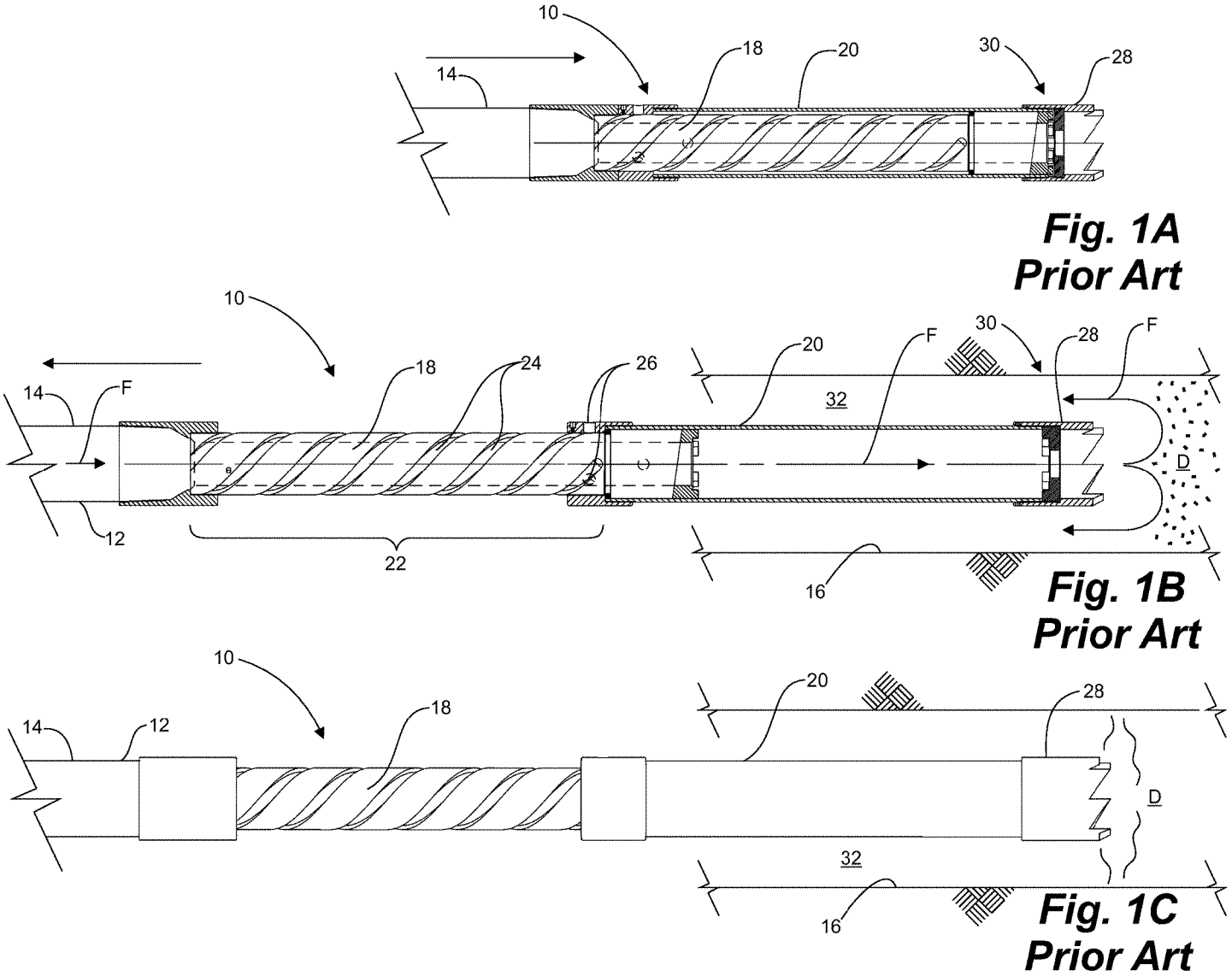
Fig. 1A Prior Art
Fig. 1B Prior Art
Fig. 1C Prior Art
FIGS. 1A, 1B and 1C are side views of a prior art wellbore obstruction clearing tool as disclosed in Applicant's related U.S. Pat. No. 8,973,682, more particularly

Having reference to FIGS. 1A to 1C, and as taught in Applicant's related U.S. Pat. No. 8,973,682, embodiments of a prior-art wellbore obstruction-clearing tool 10 are fit to a distal end 12 of a tubing string 14, such as a casing string or coiled tubing (CT). Use of embodiments of the tool 10 taught therein obviate the need to rotate the tubing string 14 as the tubing string 14 is run into or tripped out of a wellbore 16, substantially avoiding problems associated therewith, such as torque build up along the tubing string 14. The tool 10 is used to break up obstructions in the wellbore 16 permitting the tubing string 14, such as casing, to be advanced to a desired depth in the wellbore 16.

The tool 10 comprises a tubular mandrel 18 having a tubular sleeve 20 concentrically fit about the mandrel 18. Best seen in FIG. 1B, a helical drive arrangement 22, comprising helical grooves 24 and at least one coupling device, such as pins 26, for engagement therein is connected between the mandrel 18 and the sleeve 20. The pins 26, on either of the sleeve 20 or the mandrel 18 engage in the helical grooves 24, on either of the mandrel 18 or the sleeve 20, causing the sleeve 18 to rotate about the mandrel 18 as the tubing string 14 and mandrel 18, connected thereto, are reciprocated axially in the wellbore 16. Effectively, as a result of the axial reciprocation or stroking of the tubing string 14 and mandrel 18, connected thereto, the rotatable sleeve 20 is driven to extend or retract axially relative to the mandrel 18, while rotating about the mandrel 18.

A tool, such as a drill bit 28, is connected to a distal end 30 of the sleeve 20 for engaging or otherwise contacting any obstructions in the wellbore 16. At least the rotation of the sleeve 20, and the attached drill bit 28, engaging the wellbore obstruction, causes the obstruction to break up or erode, forming debris D therefrom. The debris D is conveyed to surface by fluids F, circulated downhole through the tool 10 and uphole to surface through an annulus 32 formed between the tubing string 14, tool 10 and the wellbore 16. When the obstructions are removed from the wellbore 16, the tubing string 14, for example casing, can be lowered to a target depth prior to cementing into place in the wellbore 16.

The fluid F discharging from the sleeve's distal end 30 may aid in clearing the obstructions by fluidly engaging and eroding the wellbore obstructions, such as in a jetting action. In embodiments, the fluid F is conveyed through a contiguous bore of the tool 10 and is discharged through ports 32 in the drill bit 28.

A velocity of the fluid F discharged can be increased for enhancing the fluid erosion.

Further, extending or resetting of the tubular sleeve can be through hydraulic impetus, as a result of the fluid F being circulated downhole through the tool 10 and/or by gravity, depending on the wellbore orientation. In embodiments, the fluids F circulated downhole through the obstruction-clearing tool 10 also aids in hydraulically extending the sleeve 20 during the upstroke of the tubing string 14 and mandrel 18 (FIG. 1B).

Current Tool

For the purposes of discussion, components which are the same in embodiments taught herein as those of Applicant's prior art obstruction-clearing tool are referred to using the same reference characters. Embodiments are discussed in the context of a casing string however as one will appreciate embodiments are not so limited, but are instead applicable to other types of tubing strings where rotation of the conveying tubing string is not desirable and is generally avoided.

Generally, having reference to FIGS. 2 to 5, in embodiments taught herein, internal components of an obstruction-clearing tool 40, such as the mandrel 18 and the drill bit 28, are made of drillable materials to permit drill-out following cementing and abandonment of the tool 40 in the wellbore 16.

Particularly for tools used in horizontal wellbores, the extension of the rotatable tubular sleeve 20 is aided with a biasing member, such as a spring 42. The spring 42 is concentrically fit about an outer surface 44 of the rotating sleeve 20. The spring 42 is operatively connected between the rotatable sleeve 20 and the mandrel 18. The spring 42 is compressed during the downstroke of the mandrel 18 (FIG. 3C) energizing the spring as discussed in greater detail below. The energized spring 42 thereafter, in the upstroke of the mandrel 18 (FIGS. 2, 3A), biases the rotatable sleeve 20 axially away from the mandrel 18 to aid in extension of the rotatable sleeve 20 therealong.

Unlike Applicant's prior art obstruction-clearing tool 10 and the reamer taught by Halliburton however, the spring 42 is separated from a subsequent drilling-out operation, avoiding engagement and thereby minimizing interference and problems otherwise associated therewith.

Accordingly, an embodiment of the obstruction-clearing tool 40 comprises the tubular mandrel 18, fluidly connectable to the downhole distal end 12 of a casing string 14, a tubular, rotatable sleeve 20, and a helical drive arrangement 22 operatively engaged between the mandrel 18 and the rotatable sleeve 20. The rotatable sleeve 20 moves between the retracted position (FIG. 3C) and the extended position (FIG. 3A) upon axial reciprocation of the mandrel 18 and casing string 14 connected thereto between a downstroke and an upstroke. The helical drive 22 causes the rotatable sleeve 20 to rotate about the mandrel 18 as a result of the engagement of the one or more coupling devices or pins 26 in the helical grooves 24, in a first direction and then in a second, opposite direction.

In an embodiment, the downhole stroke of the casing 12 and mandrel 18 actuates the rotatable sleeve 20 to move axially relative to the mandrel 18 to the retracted position, while concurrently rotating in the first direction. Similarly, the uphole stroke of the casing 12 and mandrel 18 actuates the rotatable sleeve 20 to move axially to the extended position, concurrently rotating in the second opposite direction.

Figure 3C:
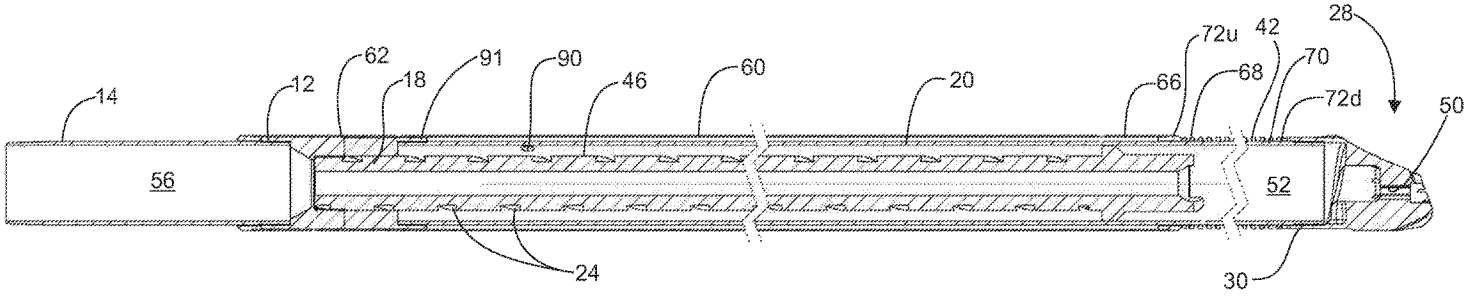
FIG. 3C is a cross-sectional view of the tool shown in FIG. 2 in the retracted position.
Figure 3A:
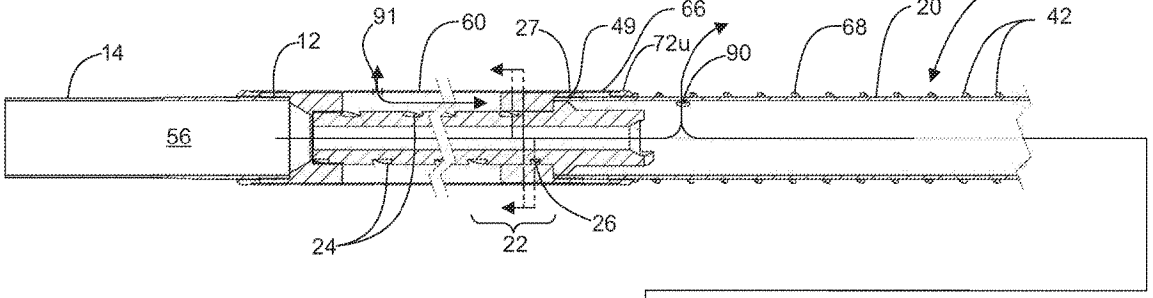
FIG. 3A is a cross-sectional view according to FIG. 2, illustrating a helical drive arrangement having helical grooves formed on the mandrel for engaging pins in a pin hub supported on the rotatable sleeve, axial reciprocation of the mandrel within the sleeve causing the rotatable sleeve to rotate as the mandrel is reciprocated between the extended position and a retracted position.
Figure 3A:
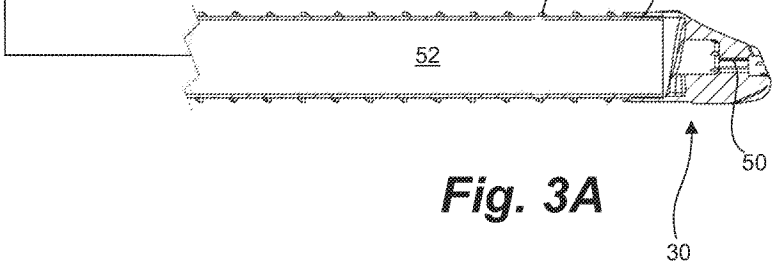
Figure 3B:
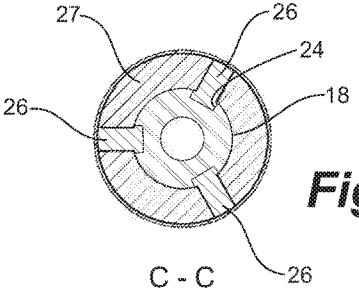
FIG. 3B is a cross-sectional view along lines C-C according to FIG. 3A, illustrating the pins in the pin hub of the helical drive arrangement according to FIG. 3A.

In an embodiment, as shown in FIGS. 3B and 3C, the one or more helical grooves 24 are formed on an outer surface 46 of the mandrel 18. The one or more coupling devices or pins 26 extend radially inwardly from the inner surface 48 of the rotatable sleeve 20. In the embodiment shown, the pins 26 extend radially inwardly from a pin hub 27 connected to a proximal end 49 of the rotatable sleeve 20.

In another embodiment, the arrangement of the pins 36 and grooves 24 are reversed. As one of skill can appreciate, helical grooves 24 are then formed on the inner surface of the rotatable sleeve 20 and the pins 26 extend radially outwardly from the outer surface 44 of the mandrel 18.

In embodiments, a disruptor, such as the drill bit 28, is fluidly connected to the distal end of the rotatable sleeve 20 to further engage and aid in clearing of the wellbore obstructions. Fluid ports 50 in the drill bit 28 are fluidly connected to an axial bore 52 of the rotatable sleeve 20, which is fluidly connected to an axial bore 54 of the mandrel 18 and to an axial bore 56 of the casing string 12 for discharging fluid F therefrom toward any obstructions.

Figure 2:
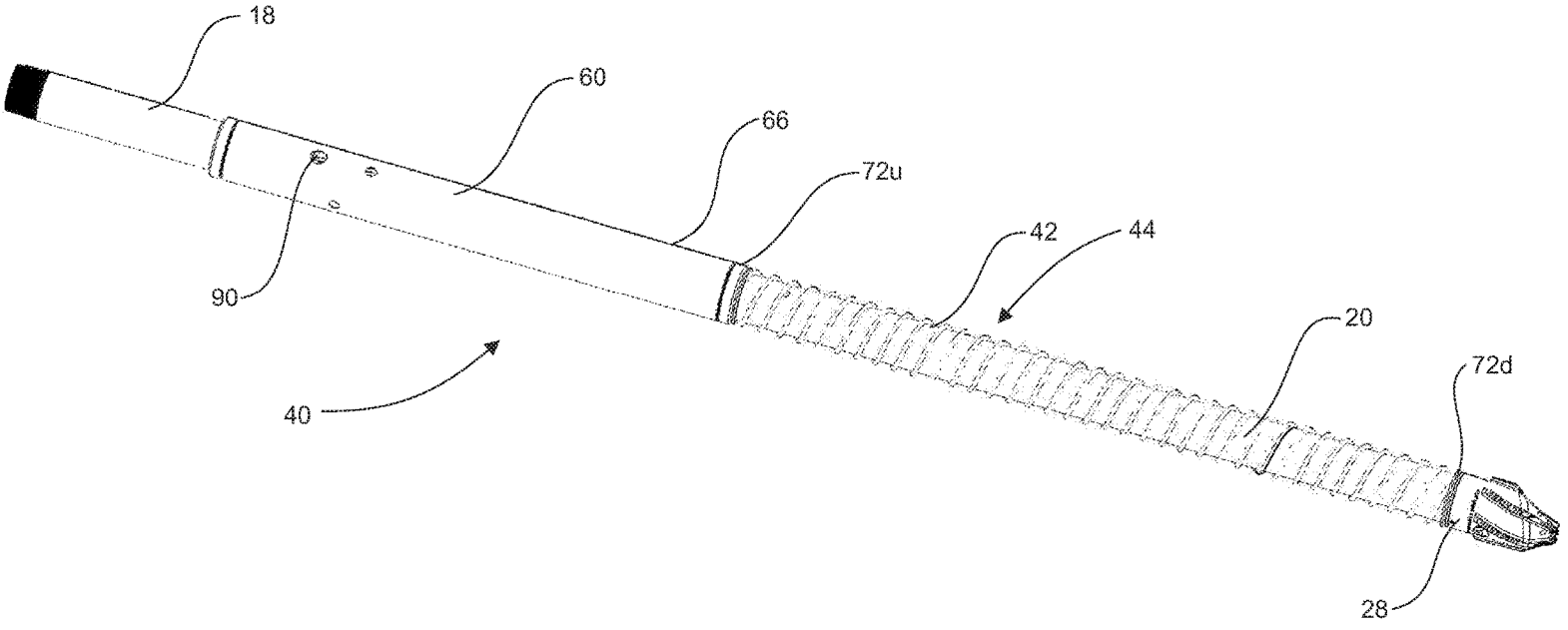
FIG. 2 is perspective view of an embodiment of a wellbore obstruction-clearing tool in an extended position, the tool having a mandrel, a rotatable sleeve positioned concentrically about the mandrel, the mandrel being axially moveable in a bore of the rotatable sleeve, a drill bit connected to a distal end of the rotatable sleeve, a biasing spring disposed externally about the rotatable sleeve for biasing the rotatable sleeve to the extended position and a nonrotatable sleeve formed concentrically about the mandrel, the mandrel being axially moveable relative thereto.

In an embodiment, as best seen in FIGS. 2 and 3A, a non-rotating drive sleeve 60 is fit concentrically about the mandrel 18 and the rotating sleeve 20. The non-rotating drive sleeve 60 acts as an uphole stop for the spring 42 and as a means for energizing the spring 42 during the downstroke of the mandrel 18. An uphole end 62 of the non-rotating sleeve 60 is fixed to an uphole end 64 of the tool 40, such as at a connection to the casing string 12. A downhole end 66 is telescopically slidable over the rotatable sleeve 20. The downhole end 66 of the non-rotating sleeve 60 also acts as the uphole stop 72*u* against which an uphole end 68 of the spring 42 engages for compressing the spring 42 thereagainst during downstroke of the mandrel 18 to the retracted position. When compressed, the spring 42 is energized. A downhole end 70 of the spring 42 bears against an opposing shoulder 72*d* at the rotatable sleeve 20, adjacent the distal end 30 thereof and above the drill bit 28. Thus, the spring 42 extends substantially the length of the rotating sleeve 20 for achieving maximal spring length. During the upstroke of the mandrel 18, the energized spring 42 extends while urging the rotating sleeve 20 to move axially to the extended position and resetting the hydraulic drive arrangement 22.

Figure 4:
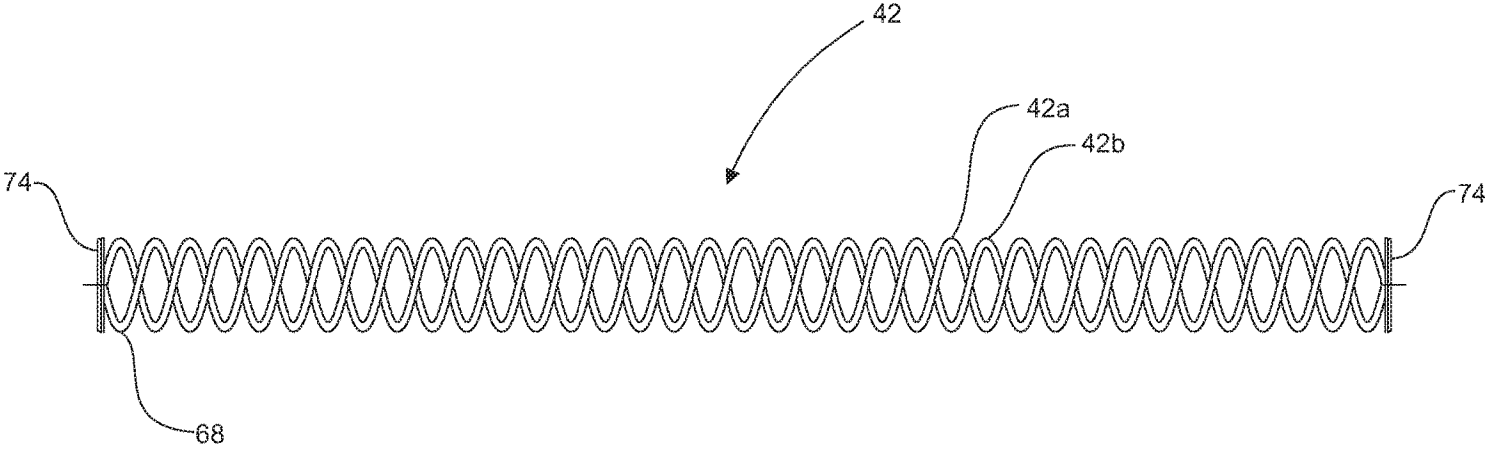
FIG. 4 is a side view of an embodiment of the biasing spring in isolation having two like springs, each secured at each end to diametrically opposing locations on end rings for forming a double helix spring.

In embodiments, having reference to FIG. 4, the biasing spring is a double-helix spring 42 comprising two like springs 42*a*,42*b*, each secured, such as by welding, to diametrically opposed points on the rings 74 located at either end thereof for forming the spring 42. The ring 74 at the uphole end 68 of the spring 42 engages the uphole stop 72*u*, formed concentrically about the rotating sleeve 20, such as at the distal end 66 thereof. The downhole end 70 of the spring 42 engages the stop 72*d* adjacent the downhole end of the rotatable sleeve 20.

In FIG. 3C, axial downhole movement of the casing string 14 and mandrel 18 is shown having engaged the rotatable sleeve 20, rotating the rotatable sleeve 20 and bit 28 connected thereto. The mandrel 18 is substantially fully engaged axially within the rotatable sleeve 20. The non-rotatable sleeve 60, supported by the mandrel 18, slides telescopically over the rotatable sleeve 20 and compresses the spring 42 axially about the rotatable sleeve 20, energizing the spring 42.

As shown in FIG. 3A, upon an axially uphole movement of the casing 14 and mandrel 18, the spring 42 urges the rotatable sleeve 20 away from the mandrel 18 and the rotatable sleeve 20 both rotates on the helical drive 22 and extends axially, resetting the tool 40 for another cycle of retraction and extension. The spring 42 is minimally preloaded, if at all, when at its maximal extension.

As discussed in the Background and in Applicant's issued U.S. Pat. No. 8,973,682, there are circumstances in which an operator may wish to drill through the obstruction-clearing tool 40, such as using a subsequent or second drill string.

The non-rotating sleeve 60 acts as an axial, external guide for the rotating sleeve 20 moving along the mandrel 18 and acts as a drill guide for guiding the subsequent or second drill string along an axial drilling path, substantially in alignment with, and coaxial within, the mandrel 18 and the rotating sleeve 20. Aligning the second drill string aids in maintaining the direction of the second drill string to mill out substantially only the internal components such as the mandrel 18 and the drill bit 28, leaving the non-rotatable sleeve 60 and the rotatable sleeve 20, thus providing protection against inadvertent engagement with the spring 42 located external to the rotatable sleeve 20 during the drill-out operation.

In embodiments, the non-rotating sleeve 60 is manufactured from materials resistant to drilling or milling, such as 4140 hardened steel. The non-rotating sleeve 60 has a diameter larger than the rotatable sleeve 20 and remains generally cemented in the wellbore 16 during and after the drill-out operation.

As seen in FIG. 3C, in the retracted position during drill-out, the non-rotating sleeve 60 provides an external guide along an entirety of the retracted tool 40. In this state, the compressed spring 42 has a relatively short or minor length extending axially downhole beyond the non-rotating sleeve 60. In embodiments, the minor length is only sufficient to accommodate the fully compressed spring 42. The rotating sleeve 20, extending axially and internal to both the non-rotating sleeve 60 and the spring 42, also acts as an internal axial drill guide along the length of the mandrel 18 and the compressed spring 42, minimizing risk of engagement of the second drill string with the spring 42.

Washers or bearings can be positioned at either end of the spring 42 at rings 74, between the spring 42 and the non-rotating sleeve 60, and between the spring 42 and the drill bit 28 for aiding in free relative rotation between the mandrel 18, rotatable sleeve 20, and spring 42, during operation of the tool 40.

In other embodiments, fluid pressure issues are managed. In operation, fluid F is continuously circulated downhole through the contiguous bore 52,54,56 of the tool 40. During downhole operations, the fluid ports 50 in the drill bit 28 may become plugged or otherwise blocked with mud and other debris, preventing the normal discharge fluid F from the tool 40. Should such a blockage of the fluid ports 50 occur, pressure in the tool 40 and within the casing string 14 would increase. The increase in pressure may be sufficient to result in premature actuation of packers and other apparatus uphole of the wellbore obstruction-clearing tool 40.

As shown in FIGS. 3A and 3C, in embodiments, optional displacement ports 90 are formed through the rotatable sleeve 20 to permit free flow of fluids from within the contiguous bore 52,54,56 of the tool 40 into the annulus 32 formed between the tool 40 and the wellbore 16 to mitigate pressure increases in the tool 40 when blockages occur in the fluid ports 50 in the drill bit 28. The displacement ports 90 can also provide alternate flow passages for cement to be injected into the annulus 32 during cementing operations, when the fluid ports 50 in the drill bit 28 are otherwise blocked with wellbore debris.

Optional displacement ports 91 are formed through the non-rotating sleeve 60 to permit the pin hub 27 to reciprocate without hydraulic locking.

In use, the impetus for the rotatable sleeve 20 to move to the retracted position, relative to the mandrel 18, is generally as a result of resistance encountered by the rotatable sleeve 20, such as when the rotatable sleeve 20 engages an obstruction, or a tight section of the wellbore 16. Impetus for the rotatable sleeve 20 to move to the extended position, relative to the mandrel 18, can be gravity, however in a horizontal wellbore it is generally by hydraulic force, created by fluid F circulated through the tool 40 and discharged from the end distal end 30 of the rotatable sleeve 20, such as through the fluid ports 50 in the drill bit 28, or as a result of the biasing spring 42 as described above, or both.

In embodiments, for use where the depth of the wellbore 16 is to be extended, following cementing of at least a first section of casing 14 into the wellbore 16, at least portions of the obstruction-clearing tool 40 must be removed by drill-out of the internal components. As the tool 40 comprises components which rotate relative to other components within the tool 40, such as rotation of the rotatable sleeve 20 relative to the mandrel 18, an accommodation must be made to avoid reactive rotation of one or more portions of the tool 40. If the portion of the tool being drilled is free to rotate during drilling, then drill-out cannot be successfully completed.

For example, when the secondary drill string and drill bit, used to drill-out components, engages the helical drive arrangement 22 between the non-rotatable mandrel 18 and the rotatable sleeve 130, once drilled free and separated from the casing 14, the mandrel 18 could freely rotate ahead of the secondary drill string, making it impossible to drill out the mandrel 18.

Figure 5:
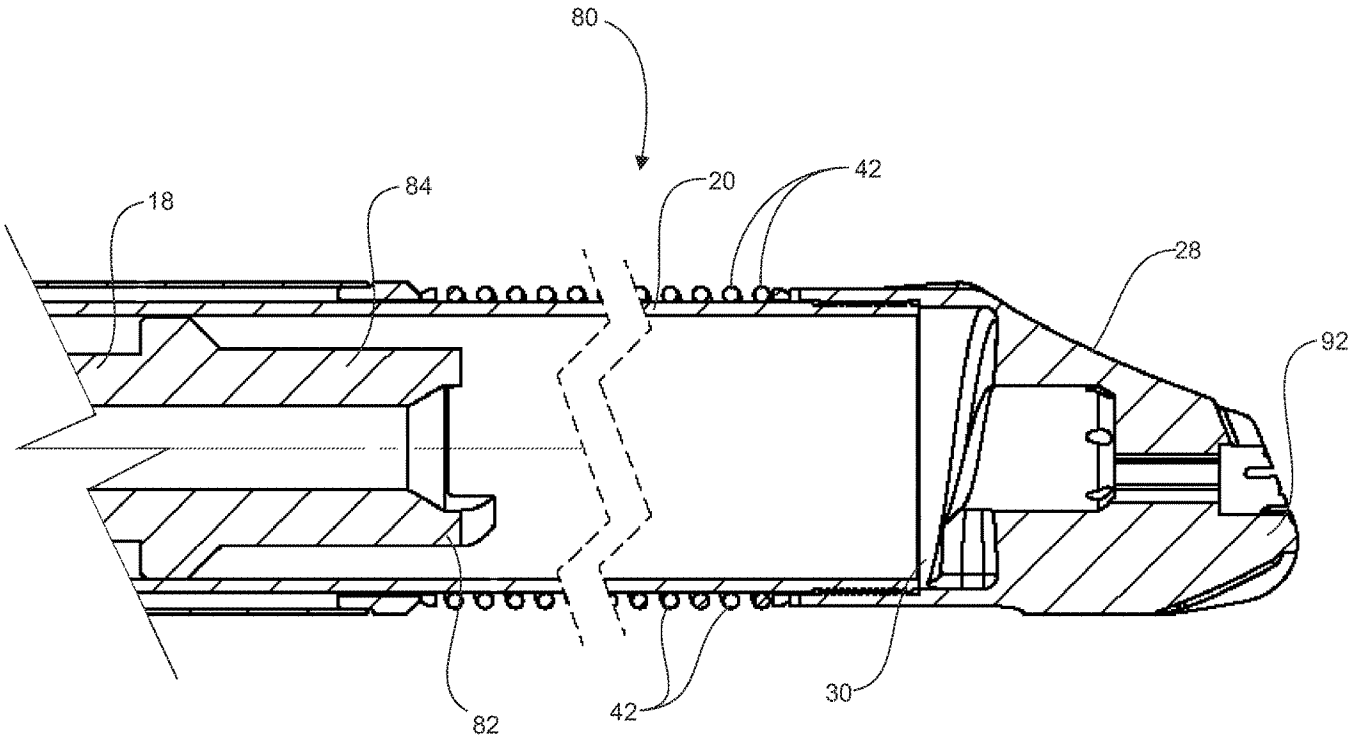
FIG. 5 is a sectional view of a distal end of the tool according to FIG. 3C illustrating a locking mechanism for preventing rotation of the mandrel relative to the rotating sleeve or drill bit during drill-out.

Accordingly, in an embodiment as shown in FIG. 5, and as discussed in Applicant's issued U.S. Pat. No. 8,973,682, a locking mechanism 80 can be used to connect between the non-rotating mandrel 18 and the rotating sleeve 20, or drill bit 28 connected thereto, in the fully retracted position, locking the downhole end and preventing independent rotation of the mandrel 18 should the connection between the mandrel 18 and the casing 14 or the mandrel 18 and the rotating sleeve 20 be compromised.

In an embodiment, the locking mechanism 80 is an interlocking interface, such as a one-way clutch or castellated interface 82, between a downhole, distal end 84 of the mandrel 18 and the downhole, distal end 30 of the rotatable sleeve 20 or drill bit 28. The interface 82 interlocks the mandrel 18 to either of the rotatable sleeve 20 or to the drill bit 28 and prevents relative rotational movement therebetween.

As discussed above, during use in horizontal wellbores, extension of the rotatable sleeve 20 can be assisted by the spring 42. As springs 42 are inherently not drillable, in the embodiments discussed above, locating the spring 42 external to the rotatable sleeve 20 separates the spring 42 from the subsequent drill string, thereby avoiding problems and interference with the drill-out operation. Following the drill-out operation, the rotatable sleeve 20, the spring 42 and the non-rotatable sleeve 60 remain in the wellbore 16.

Further, as shown in FIG. 5, the drill bit 28 can have configurations suitable for overcoming various types obstructions including a sloped, auger-shaped or eccentric leading edge 92 to aid in advancing past obstructions such as areas of sloughing along horizontal wellbores. Through rotation of the rotatable sleeve 20, the long eccentric edge or nose 92 of the bit 28 rotates upon engagement with an obstruction to align towards the open portion of the wellbore, acting as a guide to deflect off of and away from the obstructions and to continue thereby. The eccentric bit 28 features a smooth profile that enables sliding and climbing over obstructions, but is not optimized for fill agitation, nor reaming. The body of the eccentric bit 28 can be manufactured of aluminum composites for drillable removal using subsequent PDC bit-equipped secondary drill strings.

In other embodiments, the eccentric drill bit 28 may be equipped with a cutting face to assist with bridges and reaming. The long, eccentric profile seeks out the open side of the wellbore through rotation provided by the helical drive arrangement 22. Despite the eccentric shape, tool and bit rotation provides 360 degree reaming capability along its circumference with helical tungsten carbide cutting faces along a spade portion and about an uphole collar portion. Tungsten carbide buttons or tungsten carbide clusterites along the diameter resists wear. Hard facing formed along the diameter aids in minimizing body wear.

As one of skill in the art will appreciate, the obstruction-clearing tool 40 can be sized appropriately depending upon the size of the casing 10 being utilized. That is, the obstruction-clearing tool 40 can be adapted to operatively and fluidly connect to tubulars commonly used in the industry, such as 4½ inch, 5½ inch, 7 inch, or 9⅝ inch casings and 2⅞ inch coiled tubing, or can be custom sized for any size casing 10 or coiled tubing.

The embodiments in which an exclusive property or privilege is claimed are defined as follows:

1. A wellbore obstruction-clearing tool, fit to a downhole distal end of a tubing string for advancing the tubing string through obstructions in a wellbore, the tubing string having an axial tubular bore therethrough, the tool comprising:

a tubular, rotatable sleeve for engaging the obstructions, the rotatable sleeve having an axial sleeve bore extending axially therethrough and a disruptor connected to a distal end thereof;

a tubular mandrel adapted for connection to the distal end of the tubing string, the mandrel having an axial mandrel bore extending therethrough for fluid connection to the axial bore of the tubing string, the mandrel fit concentrically within the sleeve bore for axial reciprocation therein between an upstroke and a downstroke;

a helical drive arrangement acting between the mandrel and the sleeve for driving the rotatable sleeve axially and rotationally along the mandrel during the downstroke and the upstroke of the mandrel between a retracted position and an extended position respectively;

a non-rotatable sleeve fit concentrically about the mandrel and attached thereto at an uphole end, the non-rotatable sleeve being located about the helical drive arrangement and fit telescopically about at least a portion of the rotatable sleeve during reciprocation of the mandrel; and a spring fit concentrically about an external surface of the rotatable sleeve and operatively connected between a distal end of the non-rotatable sleeve and the distal end of the rotatable sleeve, wherein the distal end of the non-rotatable sleeve is for energizing the spring in the retracted position, the non-rotatable sleeve telescoping axially over at least a portion of the rotatable sleeve and the biasing spring; and in the upstroke, the energized spring biases the rotatable sleeve to the extended position, resetting the helical drive.

2. The tool of claim 1, wherein in the retracted position, the non-rotatable sleeve forms a drill guide along the mandrel; and the rotating sleeve forms a drill guide along the spring.

3. The tool of claim 2, wherein the at least the mandrel and the disruptor are manufactured of material that is less competent than the drill guides for subsequent milling out of the mandrel and disruptor from the drill guides.

4. The tool of claim 3, wherein the material of the at least the mandrel and the disruptor are selected from the group consisting of aluminum, aluminum composites, cast iron, and brass.

5. The tool of claim 3, wherein the material of the at least the mandrel and the disruptor is an aluminum composite for subsequent milling out of the mandrel and disruptor using a PDC-equipped drill bit.

6. The tool of claim 1, wherein at least the mandrel and the disruptor are manufactured of material that is less competent than hardened steel.

7. The tool of claim 6, wherein the material of the at least the mandrel and the disruptor are selected from the group consisting of aluminum, aluminum composites, cast iron, and brass.

8. The tool of claim 6, wherein the material of the at least the mandrel and the disruptor is an aluminum composite for subsequent milling out of the mandrel and disruptor using a PDC-equipped drill bit.

9. The tool of claim 1, wherein the sleeve bore is fluidly connected to the mandrel bore, the axial bores of the tubing string, the mandrel and the rotatable sleeve, forming a contiguous bore through the tool, for circulating fluid downhole therethrough for eroding the obstruction.

10. The tool of claim 9, wherein the fluid, circulating downhole therethrough, acts to hydraulically urge the rotating sleeve to the extended position.

11. The tool of claim 1, wherein the spring extends along substantially the length of the rotatable sleeve for maximizing a length of the biasing spring for resetting the helical drive arrangement and rotating sleeve to the extended position.

12. The tool of claim 1 further comprising:

a locking mechanism comprising an interlocking interface between a distal end of the mandrel and the distal end of the rotatable sleeve for connecting between the non-rotating mandrel and the rotating sleeve in the retracted position for preventing relative rotation therebetween.

13. The tool of claim 12, wherein the interlocking interface comprises a castellated interface.

14. The tool of claim 1, wherein the disruptor is a drill bit having fluid ports therein fluidly connected to the contiguous bore, the tool further comprising:

displacement ports formed through the non-rotating sleeve and through the rotatable sleeve to permit free flow of fluids from within the contiguous bore to an annulus formed between the tool and the wellbore to mitigate pressure increases in the tool if blockages form in the fluid ports in the drill bit.

15. The tool of claim 12, wherein the interlocking interface comprises a clutch interface.

* * * * *